US005165214A

United States Patent [19]

Codd

[11] Patent Number: 5,165,214

[45] Date of Patent: Nov. 24, 1992

[54] SPACE FRAME

[75] Inventor: Edwin T. Codd, Toowong, Australia

[73] Assignee: Harley Systems Pty Ltd., Rocklea, Australia

[21] Appl. No.: 654,638

[22] PCT Filed: Jul. 20, 1989

[86] PCT No.: PCT/AU89/00303

§ 371 Date: Feb. 14, 1991

§ 102(e) Date: Feb. 14, 1991

[87] PCT Pub. No.: WO90/01592

PCT Pub. Date: Feb. 22, 1990

[30] Foreign Application Priority Data

Jul. 29, 1988 [AU] Australia ..... PI9537

[51] Int. Cl.[5] ..... E04H 12/00

[52] U.S. Cl. ..... 52/648; 52/650; 52/655; 403/172; 403/171; 403/169

[58] Field of Search ..... 52/655, 650, 649, 648; 403/171, 172, 176, 169

[56] References Cited

U.S. PATENT DOCUMENTS 4,365,330 12/1982 Chopping et al. .
4,438,616 3/1984 Codd ..... 52/650
4,622,795 11/1986 Codd .
4,704,836 11/1987 Codd .

FOREIGN PATENT DOCUMENTS

60986/80 7/1980 Australia .
27451/88 7/1989 Australia .
2625599 12/1977 Fed. Rep. of Germany .
2705480 3/1978 Fed. Rep. of Germany .
WO 82/03236 9/1982 PCT Int'l Appl. .
WO 85/01078 3/1985 PCT Int'l Appl. .
WO 86/02397 4/1986 PCT Int'l Appl. .
WO 88/04345 6/1988 PCT Int'l Appl. .

*Primary Examiner*—David A. Scherbel
*Assistant Examiner*—Wynn E. Wood
*Attorney, Agent, or Firm*—Foley & Lardner

[57] ABSTRACT

A space frame of double-layer flat grid type, in which the upper grid is skewed or angularly displaced by 45° relative to the lower grid, has pairs of oblique struts (16) connecting the lower grid nodes (14) to the upper grid nodes (15). At a lower grid node (14) where two chords (10, 11) are superimposed, one pair of oblique struts (16) in a vertical plane through one chord (10) has a common terminal (17) between the two chords (10 and 11). A bolt (22) through the terminals (17) and the chords (10 and 11) secures the parts together. At the nodes (15) of the upper grid, the terminals (19) of the struts (16) are interposed between the superimposed upper grid chords (12 and 13) and secured by bolts (21).

6 Claims, 2 Drawing Sheets

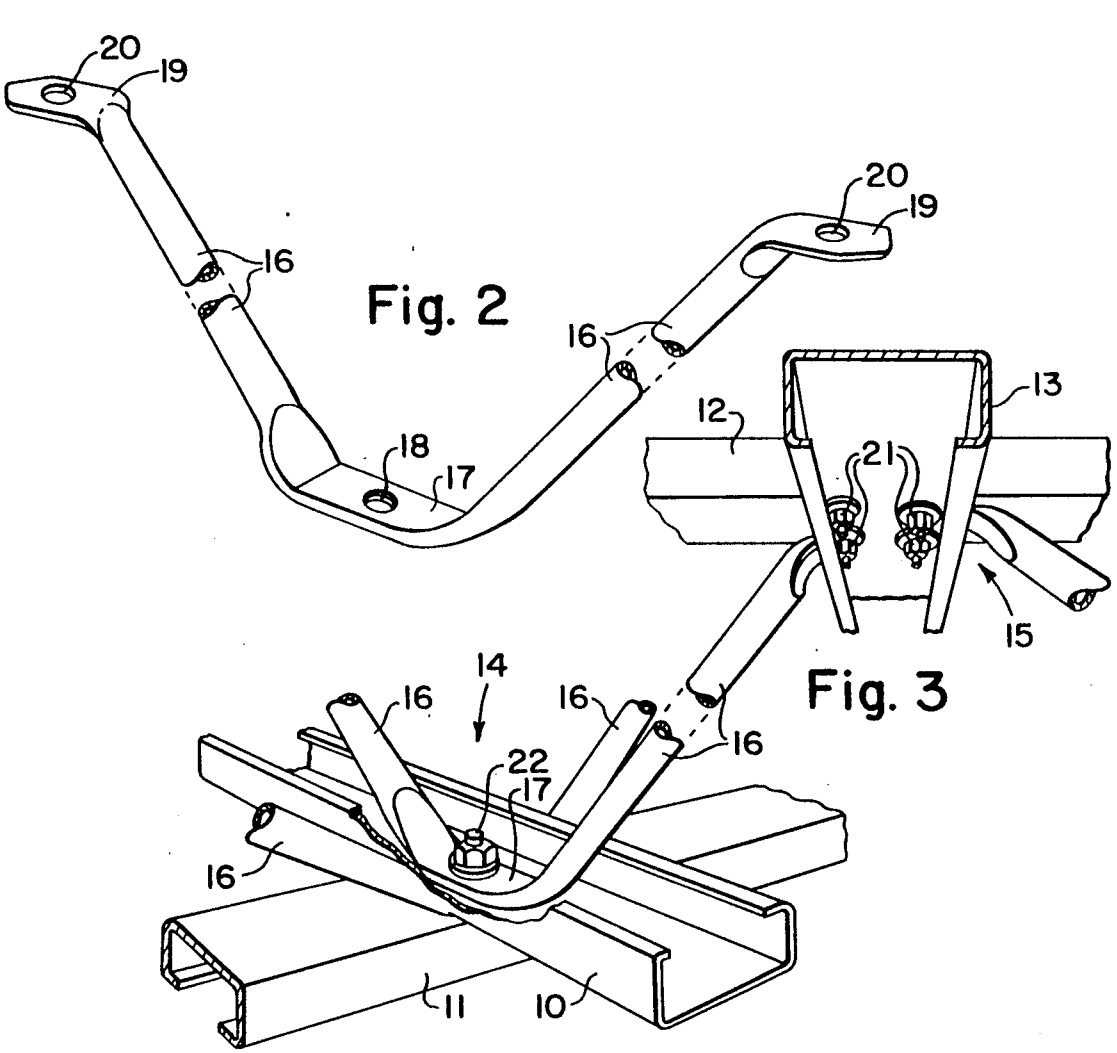
Fig. 3
Fig. 2
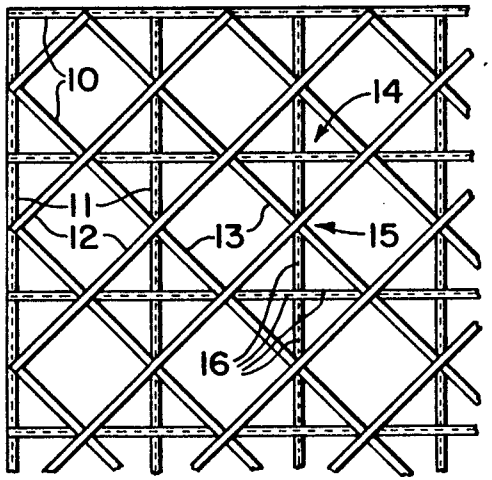
Fig. 1

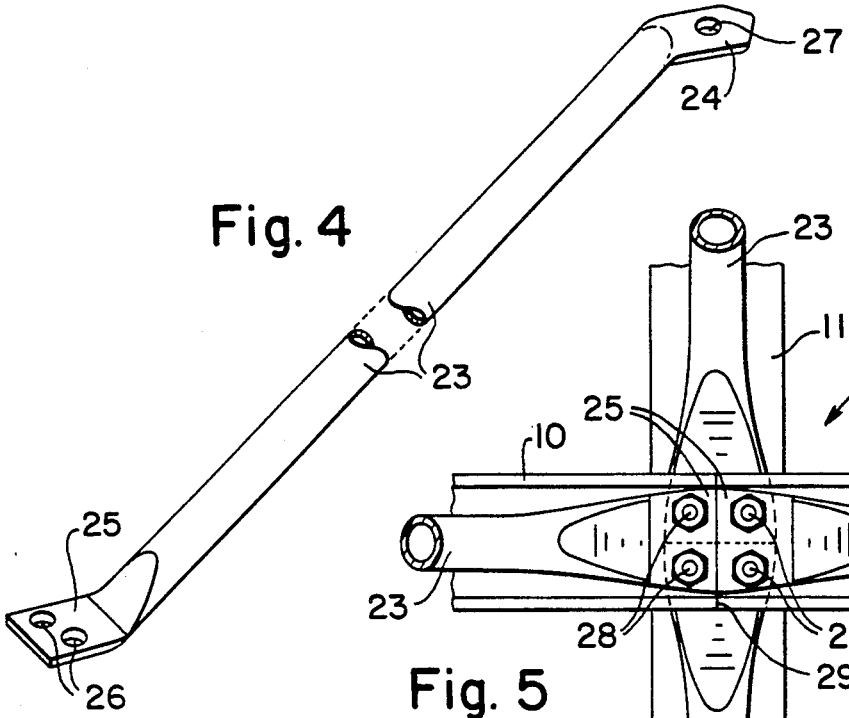
Fig. 4
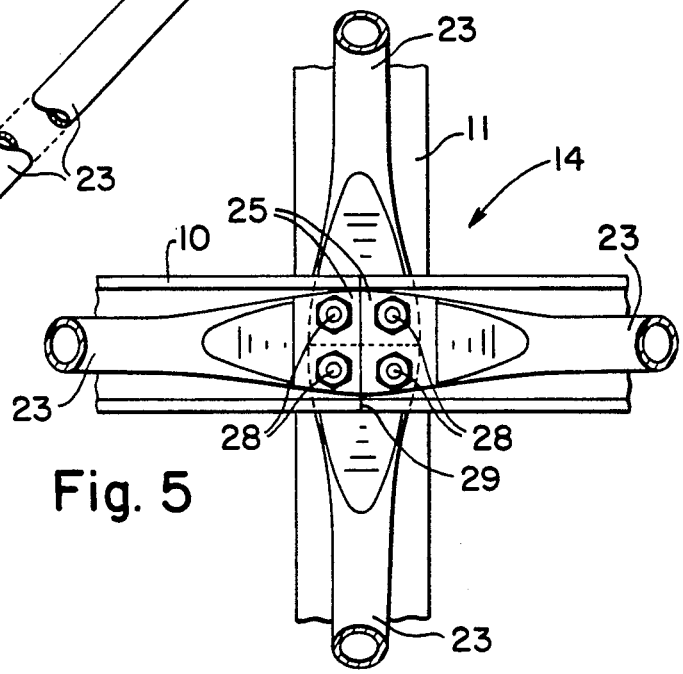
Fig. 5
Fig. 6
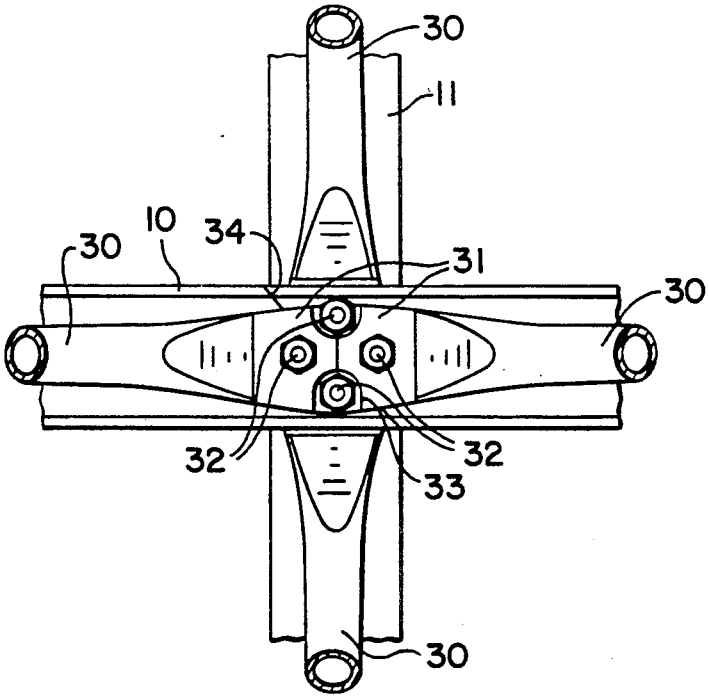

SPACE FRAME

BACKGROUND OF THE INVENTION (1) Field of the Invention

This invention relates to a space frame.

(2) Prior Art

The space frame described and illustrated in the specification of Australian Patent No. 538693 is of double-layer flat grid type, in which both the upper and the lower grids are composed of similar size squares similarly oriented, but relatively displaced so that a node of the upper grid is located over the center of a square of the lower grid, nodes of the two grids being interconnected by oblique web members or struts.

Although this configuration of space frame is widely adopted, in certain applications it is preferred that a space frame of double-layer flat grid type should have one grid skewed or angularly displaced by 45° relative to the other.

SUMMARY OF THE PRESENT INVENTION

The general object of the present invention is to provide a space frame broadly of this type which is particularly simple to make and assemble.

With the foregoing and other objects in view, the invention resides broadly in a space frame of double-layer flat grid type wherein, at a node:

two chords are superimposed;

one pair of opposed oblique struts in a vertical plane through one chord have terminals disposed on that chord;

a second pair of opposed oblique struts lying in a vertical plane through the other chord have terminals interposed between the two chords; and the chords and the strut terminals at the node are interconnected by connecting means passed through the chords and the strut terminals.

Other features of the invention will become apparent from the following description.

BRIEF DESCRIPTION OF THE DRAWINGS

In order that preferred embodiments of the invention may be readily understood and carried into practical effect, reference is now made to the accompanying drawings, wherein:

FIG. 1 is a diagrammatic plan view of part of a space frame of the type in which one grid is skewed relative to the other;

FIG. 2 is a partly broken-away perspective view of a member forming a pair of oblique struts of the space frame;

FIG. 3 is a partly broken-away perspective view of interconnected nodes of the upper and lower grids of the space frame shown in FIG. 1;

FIG. 4 is a partly broken-away perspective view of a strut of a modified form of space frame according to the invention;

FIG. 5 is a plan view of a node of the lower grid of the modified form of space frame; and FIG. 6 is a plan view of a space frame node according to a further embodiment of the invention.

DETAILED DESCRIPTION OF THE PREFERRED EMBODIMENT

In the space frame shown diagrammatically in FIG. 1, the lower grid is composed of longitudinal chords 10 and lateral chords 11 arranged in squares. The upper grid is composed of a series of chords 12 and a perpendicular series of chords 13 which are assembled in squares which are smaller than those of the lower grid and are, in plan view, at angles of 45° to the chords of the lower grid, each lower grid node 14 (except for those at the corners or sides of the space frame) being directly below the center of a square of the upper grid and therefore equidistant from four nodes 15 of the upper grid. The location of oblique struts 16 interconnecting the nodes of the upper and lower grids are indicated in broken lines in FIG. 1, these struts lying in vertical planes through the chords 10 and 11 of the lower grid.

The chords 10 and 11 of the lower grid and the chords 12 and 13 of the upper grid are all of fairly light gauge sheet metal roll-formed to lipped channel shape. At each node of the upper and the lower grid one chord member is superimposed on the other, the upper with its channel opening upwards, the lower one reversed.

In the embodiment of the invention shown in FIGS. 2 and 3, the struts or web members 16 are made as unitary pairs, each of which is formed of a single length of metal tube which at its middle is formed with a flattened section which serves as a middle terminal plate 17 and through which a single bolt hole 18 is formed. The two tubular sections or struts 16 diverge from this middle terminal plate and each, at its distal end. Each plate 19 is flattened to form an outer terminal plate 19 substantially parallel to the middle terminal plate, is mitred at its extremity and has a single bolt hole 20 formed through it.

At each upper grid node 15 two outer terminal plates 19 of two of the double strut members are interposed between the superimposed upper chord 12 and lower chord 13 and are secured by bolts 21 through the chords and interposed strut terminal plates. Preferably, as shown, four bolts 21 are used at the node, two diagonally opposed bolts securing the strut terminal plate 19 as described, the other two bolts engaging spacer washers (not shown) of equal thickness to the strut terminal plates and interposed between the two chords.

At each lower grid node 14 the middle terminal plate 17 connecting one pair of opposed struts 16 is interposed between the lower or inverted chord channel 11 and the upper chord channel 10. The middle terminal plate connecting two other opposed struts 16 is seated within the upper chord channel 10 flush upon its web. A single bolt 22 is passed through registering bolt holes 18 of the two middle terminal plates 17 of the two pairs of struts 16 and through registering bolt holes in the webs of the upper chord channel 10 and the lower chord channel 11.

In the embodiment of the invention shown in FIGS. 4 and 5, the oblique struts 23 are made as single units rather than as integral pairs. Each is of metal tube, its ends being flattened to form terminal plates 24 and 25, which are bent so that their planes are parallel and inclined to the axis of the main tubular and unflattened part of the strut.

At each node 14 of the lower grid, the strut terminal plates 25 are square-cut at their extremities, and each is formed with two bolt holes 26. At each node of the upper grid two terminal plates 24 are, as described with reference to FIG. 3, interposed between the superimposed upper chord 12 and lower chord 13 and are secured by bolts through the chords and bolt holes 27 in the interposed strut terminal plates 24.

At each lower grid node 14 the terminal plates 25 of one pair of opposed struts 23 are interposed between the lower or inverted chord channel 11 and the upper chord channel 10, the other two opposed struts 23 having their terminal plates 25 seated within the upper chord channel 10 flush upon its web. In each pair of opposed struts 23 the square-cut extremities of the terminal plates 25 abut. Four bolts 28 are passed through the registering bolt holes 26 of the two pairs of strut terminal plates 25 and through registering bolt holes in the webs of the upper chord channel 10 and the lower chord channel 11. In this embodiment of the invention, although four bolts are required to interconnect the components at each lower node, there is the advantage that if it should be necessary or desirable that a chord should be made up of two aligned sections, the arrangement of the parts allows the junction of sections of either chord, or both, to be at the node. Such a junction in the upper chord 10 is indicated in FIG. 5 at 29, and it will be seen that the sections of the chord 19 are held firmly together and in alignment by the four bolts 28.

In the modified node shown in FIG. 6 each of the struts 30 has a flattened and angled terminal plate 31 which is square-cut at its extremity and formed with a single bolt hole. As before described, the terminal plates 31 of one pair of opposed struts 30 are interposed between the upper and lower chords 10 and 11, and the terminal plates of the other pair of opposed struts are seated within the channel of the upper chord 10. Four bolts 32 hold the assembly together, but the bolts in this instance are arranged at the corners of a square the sides of which are at angles of 45° to the chords. The terminal plates 31 of each pair of struts are therefore formed with cut-away corners at their extremities, as indicated at 33, to clear the bolts 32 through the terminal plates of the other pair of struts.

In this embodiment either of the chords may be of sections interconnected at a node, the junction of such sections being indicated at 33.

I claim:

1. A space frame of the double-layer flat grid type with upper and lower grids interconnected by oblique struts, wherein, at a node:

two chords in one grid layer are superimposed;

one pair of opposed oblique struts in a vertical plane through one chord have terminals disposed on that chord;

a second pair of opposed oblique struts lying in a vertical plane through the other chord have terminals interposed between the two chords;

the chords and strut terminals at the node are interconnected by connecting means through the chords and the strut terminals; and each pair of opposed oblique struts is a single unit comprising a pair of struts interconnected by and diverging from a common terminal.

2. A space frame according to claim 1, wherein:

the common terminal of each pair of struts is formed with a single bolt hole; and the connecting means includes a single bolt through the chords and the common terminals.

3. A space frame according to claim 1, wherein:

the chords of the upper grid are skewed at angles of about 45° relative to corresponding chords of the lower grid;

each said node is in the lower grid and equidistant from nodes of the upper grid; and at each node of the upper grid a pair of opposed oblique struts have terminals interposed between two chords of the upper grid, the chords and the strut terminals being interconnected by connecting means through the chords and the strut terminals.

4. A space frame according to claim 1, wherein:

the chords of each grid are channels, the upper of the superimposed chords opening upwardly, the lower of the chords opening downwardly, and each pair of opposed oblique struts is tubular, its middle part being flattened to form the common terminal, its extremities being flattened and bent to lie in a plane parallel to that of the common terminal.

5. A space frame according to claim 2, wherein:

the chords of each grid are channels, the upper of the superimposed chords opening upwardly, the lower of the chords opening downwardly, and each pair of opposed oblique struts is tubular, its middle part being flattened to form the common terminal, its extremities being flattened and bent to lie in a plane parallel to that of the common terminal.

6. A space frame according to claim 3, wherein:

the chords of each grid are channels, the upper of the superimposed chords opening upwardly, the lower of the chords opening downwardly, and each pair of opposed oblique struts is tubular, its middle part being flattened to form the common terminal, its extremities being flattened and bent to lie in a plane parallel to that of the common terminal.

* * * * *